United States Patent [19]

Futamoto et al.

[11] 4,193,013

[45] Mar. 11, 1980

[54] CATHODE FOR AN ELECTRON SOURCE AND A METHOD OF PRODUCING THE SAME

[75] Inventors: Masaaki Futamoto, Tsukui; Ushio Kawabe, Hamuramachi; Shigeyuki Hosoki, Hachioji; Tsutomu Komoda, Hinodemachi; Shigehiko Yamamoto, Tokorozawa, all of Japan

[73] Assignee: Hitachi, Ltd., Japan

[21] Appl. No.: 897,406

[22] Filed: Apr. 18, 1978

[30] Foreign Application Priority Data

Apr. 18, 1977 [JP] Japan ..... 52-43548

[51] Int. Cl.[2] ..... H01J 1/15; H01J 9/18

[52] U.S. Cl. ..... 313/341; 29/25.14; 313/336

[58] Field of Search ..... 313/341, 336, 346 R, 313/353; 29/25.14

[56] References Cited

U.S. PATENT DOCUMENTS

| | | | |
|---|---|---|---|
| 3,532,923 | 10/1970 | Vogel | 313/341 |
| 4,054,946 | 10/1977 | Ferris et al. | 313/336 X |

FOREIGN PATENT DOCUMENTS

| | | | |
|---|---|---|---|
| 51-25061 | 3/1976 | Japan | 313/336 |
| 51-55666 | 5/1976 | Japan | 313/346 R |
| 52-22468 | 2/1977 | Japan | 313/336 |

*Primary Examiner*—Alfred E. Smith
*Assistant Examiner*—Charles F. Roberts
*Attorney, Agent, or Firm*—Craig and Antonelli

[57] ABSTRACT

A cathode for an electron source according to this invention comprises an emitter tip made of an electron emissive material, a filament for holding the emitter tip, and a binder for binding the emitter tip and the filament, the filament and the binder being made of glassy carbon. The binder can have a carbide or boride powder incorporated therein. The cathode according to this invention can be produced by using a thermosetting resin of predetermined shape as the starting material of the filament, fixing the emitter tip to a predetermined position of the thermosetting resin with the adhesive agent made of the raw thermosetting resin, and heating the resultant assembly in a non-oxidizing atmosphere to carbonize the resinous portions. This cathode is structurally very simple. Moreover, the adhesion between the filament and the emitter tip is excellent, and the emitter tip can be heated to high temperatures above 2,000° C. by causing current to flow through the cathode.

14 Claims, 5 Drawing Figures

3: Glassy Carbon containing Carbide powder and /or Boride powder

2: Glassy Carbon

CATHODE FOR AN ELECTRON SOURCE AND A METHOD OF PRODUCING THE SAME

BACKGROUND OF THE INVENTION (i) Field of the Invention:

This invention relates to a cathode for an electron source which is useful in electron beam-applying equipment such as electron microscope and electron microfabrication system, and a method of producing the cathode.

(ii) Brief Description of the Prior Art:

Carbides of elements of groups IV, V and VI in the periodic table and silicon, or borides of the alkaline earth and the rare earth are excellent electron emissive materials. Especially in the field of scientific instruments applying electron beams, they are replacing conventional cathodes employing tungsten. Lanthanum hexaboride ($LaB_6$), for example, has come into use for the electron source of a scanning electron microscope or an electron microfabrication system as a thermionic cathode material which exhibits a brightness higher than that of tungsten. Since high-melting carbides such as titanium carbide (TiC) and silicon carbide (SiC) interact little with residual gases in a vacuum and are immune to ion bombardment, they are noticed as materials for field emission cathodes of high stability and long life.

The cathodes of the thermal emission (hereinafter, abbreviated to "TE") type and the field emission (hereinbelow, abbreviated to "FE") type need to be heated to a high temperature during operation or to be heated to a high temperature in order to clean the cathode surface prior to operation. As methods of heating, there are the indirect heating method which exploits electron bombardment or the like, and the conduction heating method in which a conductive support or filament for holding the cathode is supplied with electric power so as to directly heat the cathode. With the indirect heating method, the structure of the cathode becomes complicated, so that the heat loss is usually heavy and that a high power is required for heating the cathode. On the other hand, in case of the conduction heating method, the structure of the cathode is simple and the electric power required for the heating may be low, so that it is a desirable heating method for the cathode. Especially in case of the FE cathode, it is ordinarily necessary to elevate the temperature to above 2,000° C., and a structure capable of conduction heating is required in order to effectively heat the cathode. Also in case of the TE cathode, the conduction heating is desirable as stated above.

The cathode capable of conduction heating is generally made up of a structure in which an electron emissive material is spot-welded to the central part of a conductive support made of a high-melting metal wire and according to which the cathode can be heated to a desired temperature by causing current to flow through the conductive support. A material for the conductive support needs to be one which is difficult to react with the electron emissive material. As high-melting conductive materials difficult to react with carbides and borides, the same sorts of carbides and borides and besides carbon are known. Since, however, carbides and borides are high in the cost of raw materials and are difficult in the working, they are undesirable as practical filament materials. In case of employing carbon as the filament material, there is no appropriate method for attaching the carbide or boride of the electron emissive material to the carbon filament, and hence, various contrivances are made for the attachment. By way of example, in case of $LaB_6$ being the TE cathode material, there have been proposed an expedient wherein the $LaB_6$ cathode is sandwiched between two bars of pyrolytic graphite and thus mechanically pressed and secured, and an expedient wherein a hole is provided at the center of a square pillar of $LaB_6$, two graphite sheets placed one over the other are passed therethrough, and spacers are fitted on end parts of the two graphite sheets thereby to bestow a spring action. Due to the complicated cathode structures, however, these methods involve problems in the aspects of handling, stability, reproducibility etc. and inevitably render the operating life short. Moreover, inasmuch as these measures do not perform the conduction heating very effectively, they cannot be applied to the FE cathode which is heated to a high temperature above 2,000° C. No favorable result has been obtained even in the TE cathode.

As regards the FE cathode of TiC, there has been reported an expedient wherein TiC is bound with a high-melting metal wire such as Ta wire, and this portion is fixed by being coated with a raw thermosetting resin such as phenol resin and then subjected to carbonization. However, in case where the cathode is repeatedly heated to the high temperature, such problems take place that the high-melting metal wire is carbonized to become fragile and that the portion with TiC fixed comes off on account of the differences among the coefficients of thermal expansion of TiC, the high-melting metal wire and carbon. It is therefore hard to say that this method of fixation is satisfactory in practical use.

Since carbides and borides are fragile and cannot be subjected to the spot welding, it is the actual situation that a structure of a cathode capable of simple and effective conduction heating as comparable to the tungsten cathode and a method of producing the same have not been established yet. This has been a serious obstacle to putting into practical use carbides and borides which are excellent electron emissive materials.

Techniques close to this invention are described in "S. F. Vogel; The Review of Scientific Instruments," vol. 41, No. 4 (April 1970), pages 585–587 and Japanese Unexamined Published Patent Applications No. 52-22468 and No. 51-55666. U.S. Pat. No. 4,054,946 teaches an invention of an antecedent application in U.S. although it was not publicly known prior to the original Japanese patent application of this invention.

SUMMARY OF THE INVENTION

An object of this invention is to eliminate the difficulties in the prior arts and to provide a cathode which can be readily heated to above 2,000° C. by causing current to flow therethrough, whose life is long and which has a comparatively simple structure, as well as a method of producing the cathode. Another object of this invention is to provide a novel cathode in which an emitter tip is secured to a filament made of carbon, as well as a method of producing the cathode.

In order to accomplish the objects, a cathode according to this invention comprises an emitter tip made of an electron emissive material, a filament for holding the emitter tip, and a binder for binding the emitter tip and the filament, the filament and the binder being made of glassy carbon.

A method of producing the cathode according to this invention comprises the steps of using a thermosetting resin of predetermined shape as a starting material of the filament, fixing the emitter tip to a predetermined position of the thermosetting resin with the adhesive agent made of the raw thermosetting resin, and heating the resultant assembly in a non-oxidizing atmosphere so as to carbonize the resinous portions.

As the electron emissive material constructing the emitter tip, there can be used any of usual emitter tip materials which include carbides of elements of groups IV, V and VI in the periodic table, for example, TiC, SiC and TaC and borides of alkaline-earth metal elements and rare-earth elements, for example, $LaB_6$ and $(La, Ce)B_6$.

Desirable as the thermosetting resin for the starting material of the filament is a furan resin prepared from, for example, furfural, furan, tetrahydrofurfuryl alcohol or furfuryl alcohol, or a phenol resin prepared from, for example, phenol-formaldehyde or phenol-hexamethylenetetramine. These resins turn into dense voidless vitreous carbon by carbonization, and therefore form filaments of high mechanical strength.

As the raw or unhardened thermosetting resin for fixing the emitter tip, the furan resin or the phenol resin is desirable again and brings forth a favorable state of adhesion. When a powdery carbide or boride such as TiC, ZrC, HfC, NbC, $B_4C$, $ZrB_2$, $TiB_2$, $B_6Si$ and $LaB_6$ is added to the raw thermosetting resin for use as the adhesives, a more reliable adhesion can be achieved. More specifically, in general, the coefficients of thermal expansion of the carbide or boride being the electron emissive material and the carbon of the filament or conductive support are not equal. In case of heating and cooling the cathode, therefore, a stress develops at the bonding part between the filament and the electron emissive material. In an extreme case, the bonding part comes off, and the emitter tip made of the electron emissive material falls off. In order to prevent this drawback, it is effective to employ as the bonding agent the unhardened thermosetting resin with the powdery carbide or boride added thereto. When the bonding part has been carbonized, the coefficient of thermal expansion thereof becomes a value intermediate between the coefficients of thermal expansion of the carbon of the filament and the carbide or boride being the emitter tip material, which is effective to moderate the thermal stress developing in the bonding part. Further, the carbide or boride having dispersed into the carbon get intimate or affinitive with the electron emissive material, and the bonding strength of the bonding part increases. Here, the carbide or boride powder to be used as part of the adhesives should desirably be of the same material as the electron emissive material, but it may be powder of a like carbide or boride. By way of example, in case where the emitter tip material is TiC, the powder to be used as part of the binder is not restricted to TiC, but even ZrC and HfC have similar effects and also $B_4C$ has an excellent effect. In case of employing the $B_4C$ powder, a more favorable result is obtained by adding powder of a rare-earth metal oxide thereto. The quantity of the powder to be added as part of the adhesives needs to be selected to a certain value which is at most 1 (one) relative to one volumetric-part of the unhardened thermosetting resin. The quantity of the additive powder as exceeds the one volumetric-part is undesirable because the strength of the bonding part lowers drastically.

It has been described that the furan resin or the phenol resin is desirable as the thermosetting resin for the starting material of the filament and as the raw thermosetting resin for fixing the emitter. These resins, however, are not restricted to the furan or phenol resin, but may be any other resinous material which turns into vitreous carbon by means of carbonization, for examle, polyvinylidenechloride or pitch. The starting material of the filament and the unhardened thermosetting resin for the fixation of the emitter are not restricted to the same sorts of materials, but may be different sorts of materials.

As the atmosphere at the time when the resinous portions are heated for carbonization, there is employed an inert atmosphere such as of Ar and He, a neutral atmosphere such as of $N_2$, a reducing atmosphere such as of $H_2$, of a vacuum atmosphere. In order to promote the carbonization and to promote the desorption of elements other than carbon, the vacuum atmosphere is the most desirable.

The heating temperature and the heating period of time for the carbonization of the resinous portions are 1,300° C.–2,500° C. and 0.5 hour–10 hours, respectively. When the heating temperature and the heating period of time are below these values, the carbonization is insufficient. On the other hand, when they are above the values, the treatment becomes uneconomical, and moreover, such a trouble that the emitter material vaporizes and consumes is feared to occur due to heating at an excessively high temperature and/or for an excessively long time. Although the heating rate at the carbonization of the resinous portions differs depending on the sort of the resin, it needs to be selected so as not to exceed approximately 500° C./hr. Otherwise, there is a higher probability that glassy carbon of good quality will not be manufactured.

The emitter tip made of the electron emissive material must be worked into a desired shape. It is favorable to execute the working after completion of the carbonization of the resinous portions, because it serves also for the cleaning of the emitter tip. The shaping of the emitter tip is ordinarily done by etching, and the electro-etching process which is well known in the art is often adopted.

In this way, the cathode which can be heated by causing current to flow therethrough and which employs the carbide or boride for the emitter tip can be produced. Inasmuch as the filament and the binder of the cathode are the carbon having a high melting point, the emitter tip can be heated to a high temperature above 2,000° C. Since, in case of the FE cathode, the size of the emitter tip can be made very small, the thickness of the filament ought to become small, and the electric power required for the heating may be very low. Furthermore, since the filament and the binder are the glassy carbon of quite an identical substance and both are integrally and simultaneously carbonized, the adhesion between the filament and the emitter tip are excellent, and the cathode operates stably even when used for a long time.

The principal features of the cathode according to this invention are summed up as follows:

(1) The cathode material can have the temperature elevated to above 2,000° C. by conduction heating.
(2) The structure is very simple.
(3) The adhesion between the filament and the emitter tip is favorable.
(4) The operating life is long.

The cathode and the method of producing the same according to this invention are not restricted to the emitter tip of the carbide or boride as described above, but they are, in principle, applicable to obtaining an emitter tip of an electron emissive material which is difficult to react with carbon or an electron emissive material which forms a stable reaction layer but with which the reaction does not proceed beyond a certain degree. In addition, the method of producing the cathode according to this invention is very simple and can easily mass-produce the cathodes of an identical rating.

This invention is excellent in such points of wide application and easy mass-production, and is greatly effective in practical use.

BRIEF DESCRIPTION OF THE DRAWINGS

FIG. 1*a* is an explanatory view showing a cathode in an embodiment of this invention, while

DETAILED DESCRIPTION OF THE PRESENTLY PREFERRED EMBODIMENTS

EXAMPLE 1

Figure 1A:
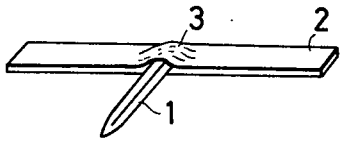
Figure 1B:
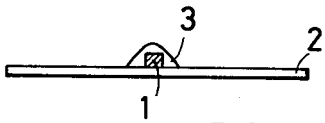
FIG. 1*b* is a sectional view of the cathode shown in FIG. 1*a*.

0.8 weight-% of p-toluenesulfonic ethyl $C_6H_4(CH_3)(SO_3C_2H_5)$ was added as a catalyst to furfuryl alcohol $C_5H_6O_2$, and the furfuryl alcohol was polymerized to fabricate a resinous bulk. A sheet shaped into a rectangle 0.7 mm wide, 0.35 mm thick and 12 mm long was cut out of the resinous bulk. Subsequently, as shown in FIGS. 1*a* and 1*b*, a $LaB_6$ single crystal 1 having a section of 0.15 mm×0.15 mm and a length of 4 mm was mounted on the central part of the resinous sheet 2 by employing as a cement or binder 3 the resin in the raw or unhardened state. After completely hardening the cementing portion, the resultant assembly was put into a flat-bottomed graphite boat. While depressing it by a graphite block, it was heated for carbonization in a vacuum up to 1,000° C. at a rate of 2° C./min and then up to 1,700° C. at a rate of 10° C./min. The depression by the graphite block was done in order to prevent the resinous sheet 2 from being deformed at the carbonization. With the carbonization, the length of the sheet shrank equidimensionally by about 20%. Subsequently, the $LaB_6$ single crystal was worked into the form of a needle by the electro-etching in which an a.c. voltage of 2.5 V was applied to the single crystal in an aqueous solution of nitric acid at a concentration of 25 weight-%.

Figure 2:
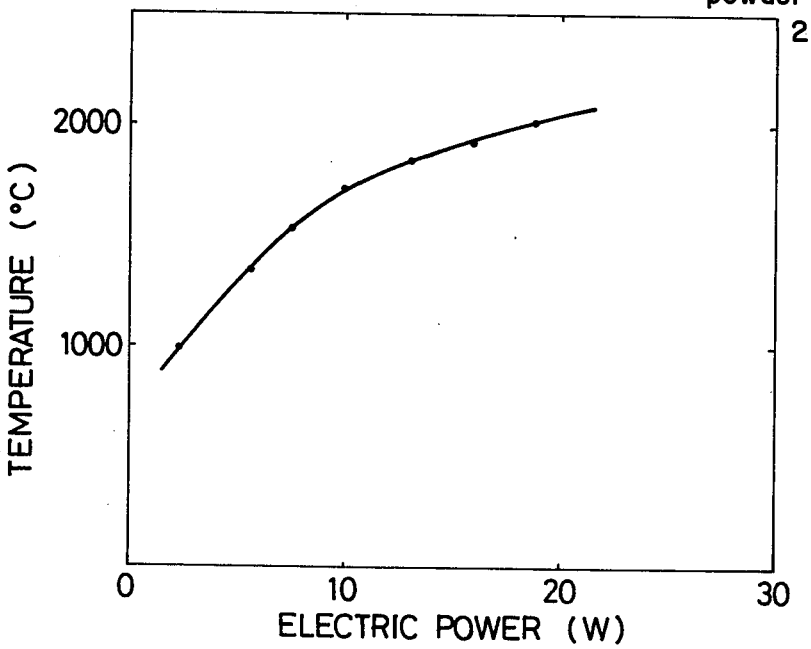
FIG. 2 is a graph showing the conduction-heating characteristic of the cathode illustrated in FIG. 1*a*.

The conduction-heating characteristic of this cathode is illustrated in FIG. 2. While the operating temperature range of a $LaB_6$ thermal emission cathode is 1,500°–1,600° C., electric power required for heating the cathode to the temperature is approximately 9 W, which is less than the power consumption of the prior-art cathode of the indirect heating type. Even when a rapid-heating and rapid-cooling treatment in which this cathode was quickly cooled after the conduction heating to the temperature of 1,600° C. was repeated 500 times, the state of the bonding portion between the $LaB_6$ tip and the carbon of the filament was held good, and quite no hindrance in practical use took place.

EXAMPLE 2

Furfural $C_5H_4O$ and pyrole $C_4H_5N$ were mixed at a volumetric ratio of 2:1, and the mixture was polymerized by employing an acid as a catalyst. Thus, a resinous bulk was fabricated. A V-shaped sheet 0.6 mm wide and 0.3 mm thick was cut out of the resinous bulk. Subsequently, a TiC crystal having a diameter of 0.05 mm and a length of 2 mm was mounted on the apex of the V-shaped sheet. As a bonding agent at this time, there was used a paste in which TiC powder of 325 meshes and the unhardened furfural-pyrole resin were mixed at a volumetric ratio of 1:2. Thereafter, a heat treatment was carried out as in Example 1, to carbonize the V-shaped sheet and the bonding portion. Subsequently, the TiC crystal was electro-etched at a d.c. voltage of 5–10 V in in an electrolyte of fluoric and nitric acids (a solution in which 40%-HF and conc. $HNO_3$ were mixed at 3:5), and was worked into a sharp needle. Thus, a cathode was completed. Both the ends of the V-shaped sheet were fixed by a holder made of a high-melting metal, the holder was installed in high-vacuum apparatus, and the conduction-heating characteristic was measured. As a result, it was found that the cathode can be readily heated to a high temperature above 2,000° C. by causing a current of 4–8 A to flow through the V-shaped sheet. The cathode was used for trial as the electron source of a scanning electron microscope which had employed the prior-art tungsten FE cathode. Then, the cathode of this example was stable against mechanical oscillations and repeated heating, and troubles such as falling-off of the TiC crystal did not occur.

EXAMPLE 3

A sheet 0.5 mm wide, 0.2 mm thick and 10 mm long was cut out of a phenol resin plate commercially available. A SiC whisker having a diameter of 10 μm was cemented to the center of the sheet. Used as a cement was a polymer which was prepared from phenol $C_6H_5OH$ and hexamethylenetetramine $C_6H_{12}N_4$. Thereafter, the cementing portion and the sheet were carbonized by the same method as in Example 1. The SiC whisker was electro-etched in a fluoric acid series electrolyte (a solution in which 40%-HF, $H_3PO_4$, $H_2SO_4$ and $CH_3COOH$ were mixed at 4:2:2:1) by applying a d.c. or a.c. voltage of 2–10 V, and was worked into the form of a needle. Then, the cathode of the field emission type was obtained. The cemented state between the SiC and the filament made of the carbon sheet was excellent, and the SiC could be efficiently heated by supplying the carbon sheet with electric power.

EXAMPLE 4

A sheet of the furan resin 0.8 mm wide, 0.4 mm thick and 15 mm long was fabricated by the method of manufacture described in Example 1. A TaC crystal which had a section of 0.2 mm×0.2 mm and a length of 3 mm was stuck to the central part of this sheet. Used as a bonding agent was a material in which powder of NbC of 325 meshes and the raw furan resin were mixed at a volumetric ratio of 1:2. Thereafter, the bonding portion and the resinous sheet were carbonized by the same method as stated in Example 1. An end of the TaC crystal was worked into the form of a needle in an electrolyte of fluoric and nitric acids (a solution in which 40%-HF and conc. $HNO_3$ were mixed at 3:5) by applying a d.c. voltage of 5–15 V. Then, a cathode of the field emission type was obtained.

The bonding portion of this cathode was satisfactorily stable against repeated heating, and quite no trouble occurred even when the cathode was quickly heated and cooled in a temperature range of 2,000°-2,500° C. several tens times.

EXAMPLE 5

Figure 3:
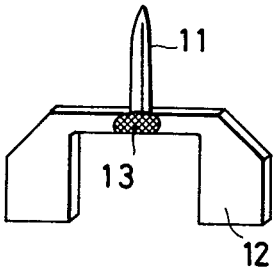
FIG. 3 is an explanatory view showing a cathode in another embodiment of this invention.

0.8 weight-% of p-toluenesulfonic ethyl was added as a catalyst to furfuryl alcohol, and the furfuryl alcohol was polymerized to fabricate a resinous bulk. A resinous sheet which was 0.35 mm thick and which had a shape of a support 12 shown in FIG. 3 was cut out of the resinous bulk. As illustrated in the figure, a $LaB_6$ single crystal 11 which had a section of 0.15 mm×0.15 mm and a length of 4 mm and whose crystal orientation was <0 0 1> was mounted on the central part of the resinous sheet 12 by employing as a binder 13 a pasty mixture in which 30 volume-% of $B_4C$ powder of 325 meshes was added to the raw resin referred to above. After heating and hardening the bonding portion, the whole assembly was put into a flat-bottomed graphite boat. While depressing it by a graphite block, it was heated for carbonization in a vacuum up to 1,000° C. at a rate of 2° C./min. and then up to 1,650° C. at a rate of 15° C./min. The depression by the graphite block was done in order to prevent the resinous sheet 12, to become the conductive support, from crooking at the carbonization. Due to the carbonization, the resinous sheet 12 shrank by about 20%. Subsequently, the $LaB_6$ single crystal was worked into the form of a needle by the electro-etching in which an a.c. voltage of 3 V was applied to the crystal in a 20 weight-% aqueous solution of nitric acid. Thus, a cathode of the direct heating type in which the electron emissive material was the $LaB_6$ single crystal and the conductive support was made of the vitreous carbon was produced.

The generation of cracks was hardly noted in the bonding portion between the $LaB_6$ single crystal and the glassy carbon filament.

This direct heating cathode was subjected in a vacuum of $5\times10^{-7}$ Torr to continuous heating at 1,550° C. which is the operating temperature of a $LaB_6$ thermal emission cathode. Then, the bonding portion was perfect even after lapse of 1,000 hours. In the same kind of direct heating cathode, a test of intermittent heating to 1,600° C. was conducted. Then, even when the intermittent heating was carried out 500 times or more, the bonding portion of the $LaB_6$ single crystal was perfect, and quite no trouble including the generation of cracks, etc. took place.

EXAMPLE 6

A U-shaped resinous sheet 0.3 mm thick was cut out of a phenol resin plate commercially available. A (La, Ce)$B_6$ single crystal being a thermionic cathode material which had a section of 0.1 mm×0.1 mm and a length of 3 mm and whose crystal orientation was <0 0 1> was bonded to the central part of the resinous sheet by employing as an adhesive agent a solution in which 20 volume-% of $B_4C$ powder (400 meshes) was mixed into an unhardened viscous resin obtained by polymerizing a mixture consisting of phenol and hexamethylenetetramine. Subsequently, the adhesive agent was heated and hardened. Thereafter, a heat treatment for carbonization was carried out under the same conditions as in Example 5.

Figure 4:
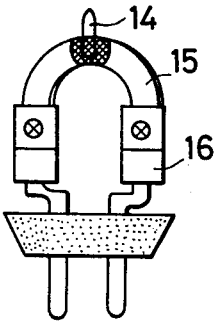
FIG. 4 is an explanatory view of a cathode in still another embodiment of this invention.

The (La, Ce)$B_6$ single crystal was electro-etched in a 20 weight-% aqueous solution of nitric acid by applying an a.c. voltage of 2 V and worked into the form of a needle. Thus, a direct heating type cathode shown in FIG. 4 was fabricated. The generation of cracks etc. was not noted at the bonding portion between the (La, Ce)$B_6$ single crystal 14 and the conductive support 15, and the state of bonding was good. This direct heating cathode was fixed by a holder 16 made of a high-melting metal as shown in FIG. 4, and was used as the electron gun of a scanning electron microscope.

EXAMPLE 7

Furfural and pyrole were mixed at a volumetric ratio of 2:1, and the mixture was polymerized by employing an acid as a catalyst. Thus, a V-shaped resinous sheet 0.6 mm wide and 0.3 mm thick was fabricated. A $LaB_6$ single crystal which had a section of 0.12 mm×0.12 mm and a length of 5 mm and whose crystal orientation was <0 0 1> was stuck to the apex of the V-shaped resinous sheet by employing as adhesives a paste in which $B_4C$ powder of 325 meshes and $Pr_2O_3$ powder of 500 meshes were mixed into the raw resin referred to above. The mixing proportions of the adhesives were 15-30 volume-% of $B_4C$ powder, 5-10 volume-% of $Pr_2O_3$ powder and 80-60 volume-% of raw resin. After hardening the bonding portion, a heat treatment for carbonization and a working of the $LaB_6$ crystal into the form of a needle were executed by the same methods as in Example 5. Further, the whole assembly was heated at 1,700° C. for 1 hour.

Cracks scarcely appeared in the bonding portion. When the section of the bonding portion was observed, royal purple $PrB_6$ produced by the reaction between $B_4C$ and $Pr_2O_3$ was uniformly distributed, and it could be confirmed that the adhesion between the $LaB_6$ single crystal and the carbon filament was perfect.

The direct heating cathode manufactured by this method was fixed by the same holder made of the high-melting metal as used in Example 6, and was employed as the electron gun or electron source of an electron microscope. Electric power required for heating the cathode to 1,550°-1,650° C. which is the operating temperature of $LaB_6$ being a thermionic cathode material was about 8 W. It was found that this direct heating cathode is equal in easy handling to the prior-art electron gun employing a tungsten filament and increases the brightness one order or more, so the performance of the electron microscope is sharply enhanced. Even when heating was repeatedly executed under a vacuum of $10^{-6}$ Torr, quite no trouble occurred in practical use, and it could be confirmed that the cathode operated stably as the electron gun.

In this manner, when the raw thermosetting resin in which the powder of a rare-earth metal oxide is added besides the $B_4C$ powder is employed as the binder, a more favorable result is obtained.

As apparent from the foregoing examples, the structure of the cathode and the method of producing it according to this invention are very significant in putting into practical use a cathode in which a carbide or boride having an excellent electron emissive characteristic is employed as an emitter tip material.

What is claimed is:

1. In a cathode having an emitter tip made of an electron emissive material, a filament for holding the emitter tip, and a binder for bonding the emitter tip and the filament, a cathode characterized in that said filament is made of glassy carbon and said binder is made of glassy carbon containing at least one of carbide powder and boride powder.

2. A cathode according to claim 1, wherein said binder is the glassy carbon containing powder of at least one substance selected from the group consisting of TiC, ZrC, HfC, NbC, $B_4C$, $ZrB_2$, $TiB_2$, $B_6Si$ and $LaB_6$.

3. A cathode according to claim 1, wherein said binder is the glassy carbon containing powder of $B_4C$ and powder of a rare-earth metal oxide.

4. In a method of producing a cathode which has an emitter tip made of an electron emissive material, a filament for holding the emitter tip, and a binder for bonding the emitter tip and the filament, a method of producing a cathode characterized by comprising the step of fixing said emitter tip to a predetermined position of a thermosetting resin of predetermined shape being a starting material of said filament by means of the adhesive agent made of the raw thermosetting resin, and the step of heating the resultant assembly in a non-oxidizing atmosphere and carbonizing the resinous portions.

5. A method of producing a cathode according to claim 4, wherein said raw thermosetting resin contains at least one of carbide powder and boride powder.

6. A method of producing a cathode according to claim 4, wherein said raw thermosetting resin contains powder of at least one substance selected from the group consisting of TiC, ZrC, HfC, NbC, $B_4C$, $ZrB_2$, $TiB_2$, $B_6Si$ and $LaB_6$.

7. A method of producing a cathode according to claim 4, wherein said thermosetting resin of predetermined shape and said raw thermosetting resin are one resin selected from the group consisting of a furan resin and a phenol resin.

8. A method of producing a cathode according to claim 5, wherein said thermosetting resin of predetermined shape and said raw thermosetting resin are one resin selected from the group consisting of a furan resin and a phenol resin.

9. A method of producing a cathode according to claim 4, wherein said raw thermosetting resin contains powder of $B_4C$ and powder of a rare-earth metal oxide.

10. A cathode according to claim 1, wherein said binder is the glassy carbon containing powder of the electron emissive material of which the emitter tip is made.

11. A cathode having an emitter tip made of an electron emissive material, a filament for holding the emitter tip and a binder for bonding the emitter tip and the filament, said binder containing at least one of carbide powder and boride powder, formed by fixing said emitter tip to a predetermined position of a thermosetting resin of predetermined shape, which is a starting material of said filament, by means of an adhesive agent made of a raw thermosetting resin and having incorporated therein at least one of carbide powder and boride powder, said raw thermosetting resin being a starting material of said binder, and then heating the resultant assembly in a non-oxidizing atmosphere and carbonizing the resinous portions.

12. A cathode according to claim 11, wherein said raw thermosetting resin has incorporated therein powder of at least one substance selected from the group consisting of TiC, ZrC, HfC, NbC, $B_4C$, $ZrB_2$, $TiB_2$, $B_6Si$, and $LaB_6$.

13. A cathode according to claim 11, wherein said raw thermosetting resin has incorporated therein powder of the electron emissive material of which the emitter tip is made.

14. A cathode according to claim 11, wherein said thermosetting resin of a predetermined shape and said raw thermosetting resin are made of a resin selected from the group consisting of a furan resin and a phenol resin.

* * * * *